United States Patent [19]

Gruetter et al.

[11] 4,015,844

[45] Apr. 5, 1977

[54] SHEET CONVEYING DEVICE FOR A PLATEN PRESS

[75] Inventors: Walter Gruetter, Morrens; Jean-Daniel Bron, Prilly, both of Switzerland

[73] Assignee: J. Bobst & Fils, S.A., Switzerland

[22] Filed: May 5, 1976

[21] Appl. No.: 683,403

[30] Foreign Application Priority Data

May 7, 1975 Switzerland ..... 005859/75

[52] U.S. Cl. ..... 271/266; 271/277; 271/204

[51] Int. Cl.[2] ..... B65H 5/02

[58] Field of Search ... 271/277, 266, 198, 204–206, 271/82

[56] References Cited

UNITED STATES PATENTS

| | | | |
|---|---|---|---|
| 2,850,280 | 9/1958 | Kalbermatten | 271/206 X |
| 3,405,937 | 10/1968 | Schoch | 271/206 |

*Primary Examiner*—Richard A. Schacher
*Attorney, Agent, or Firm*—Hill, Gross, Simpson, Van Santen, Steadman, Chiara & Simpson

[57] ABSTRACT

A conveying device for intermittently conveying a sheet through a platen press having a pair of endless chains with gripper bars extending therebetween, a drive shaft having drive sprockets engaging each of the pair of chains, at least one driven sprocket for each of the pair of chains, means including an oscillating sector gear for intermittently rotating the drive shaft characterized by at least one of the driven sprockets having an axial extension, braking means supported on a portion of the press frame adjacent each of the extensions for engaging the extension, means including at least one blower for cooling the braking means and means for actuating the braking means including a control shaft which is rotated one complete revolution for each cycle of oscillation of the sector gear and has means for causing the engagement and disengagement of the braking means during a portion of each revolution thereof. Preferably, the control shaft supports a disk-shaped programmer having an annular notch which is sensed by a magnetic sensing device that applies a signal to a valve which controls the selective application of pressure on the braking devices.

10 Claims, 6 Drawing Figures

Fig. 3
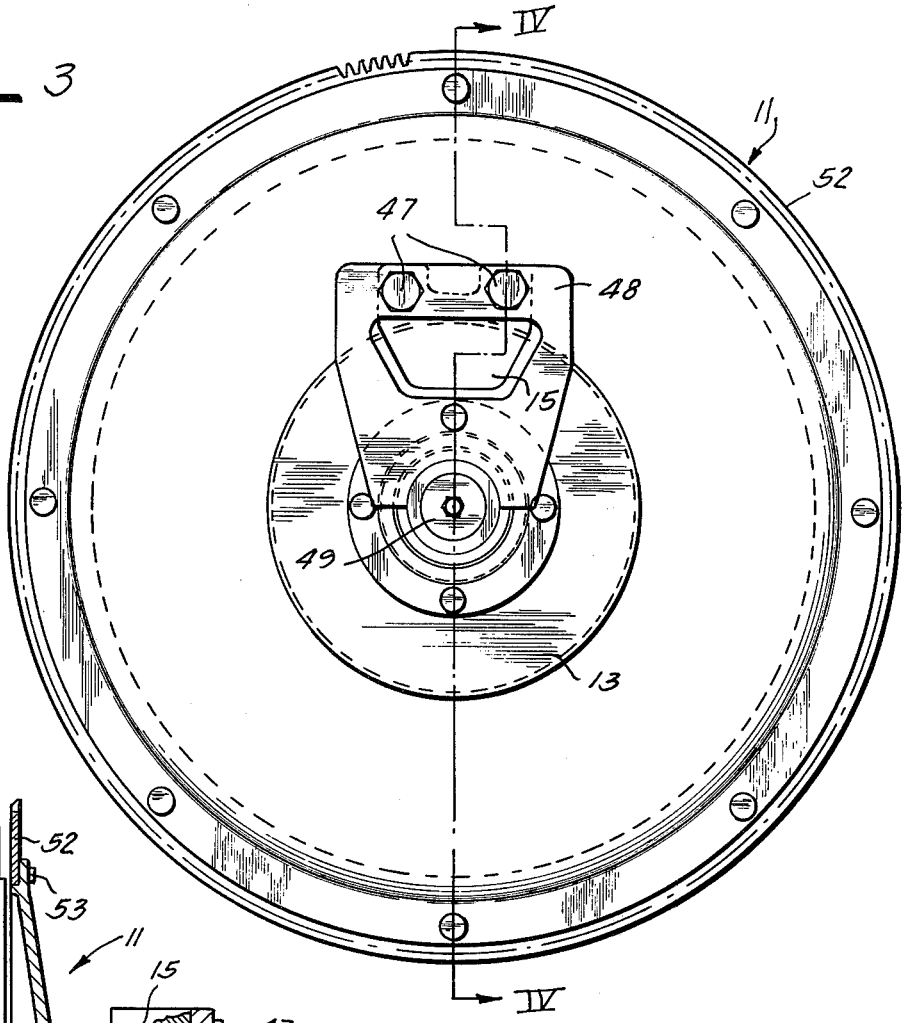
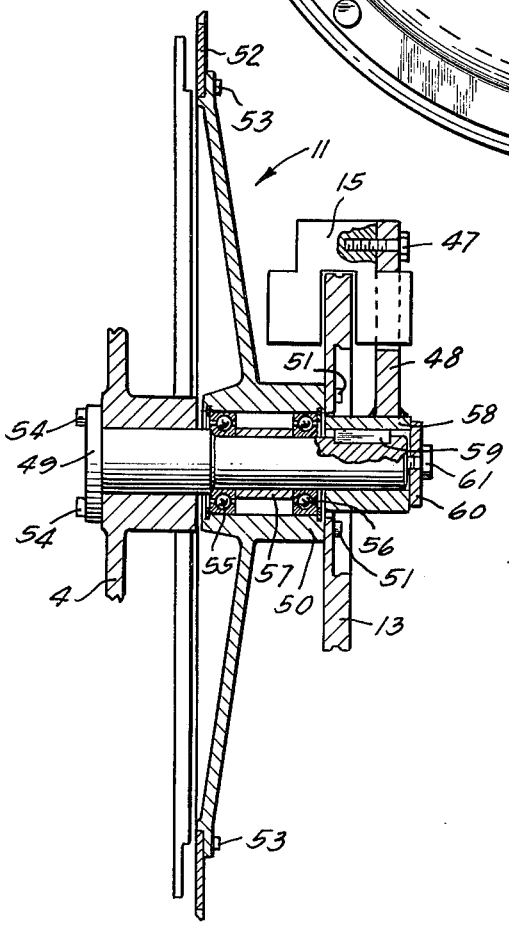
Fig. 4

Fig. 5
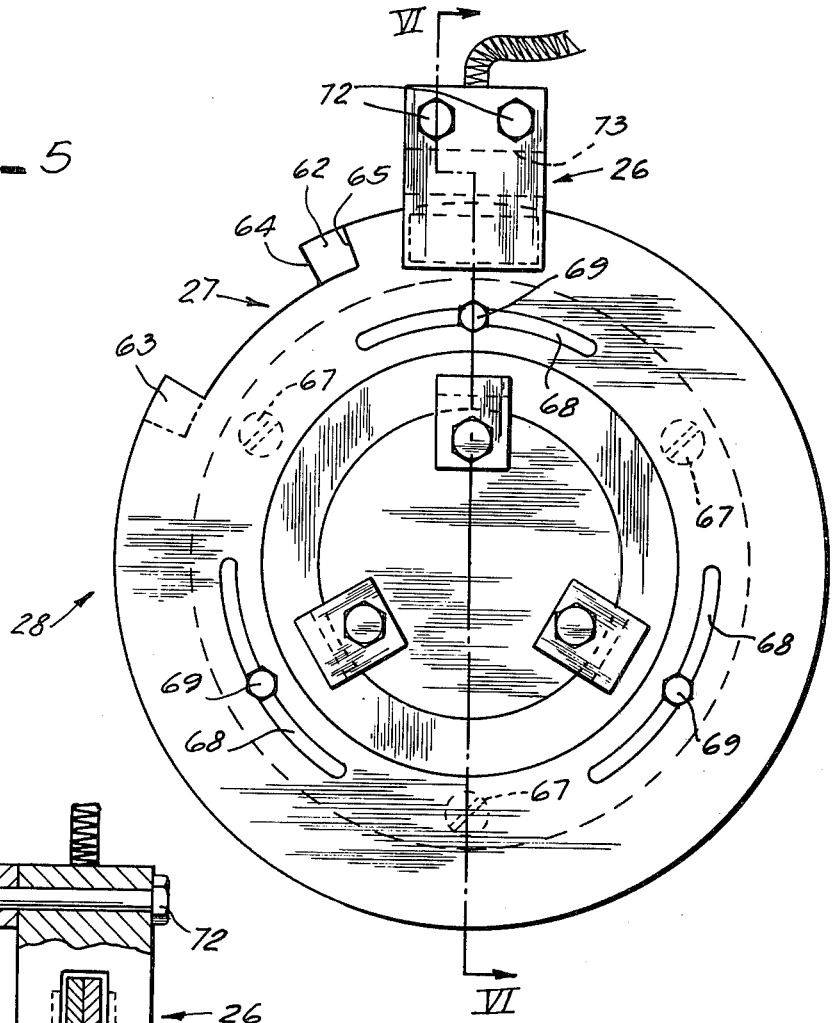
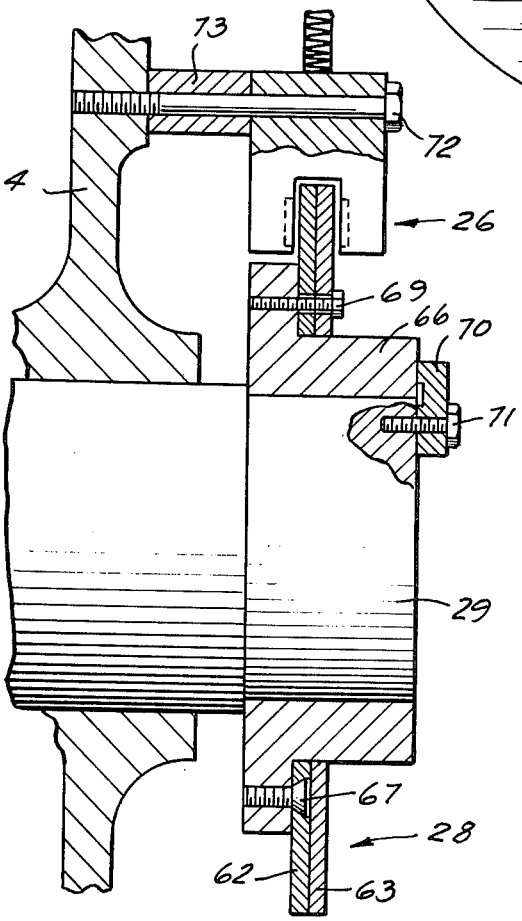
Fig. 6

SHEET CONVEYING DEVICE FOR A PLATEN PRESS

BACKGROUND OF THE INVENTION

1. Field of the Invention

The present invention is directed to a device for conveying a sheet between stations of the platen press with a dwell period at each station.

2. Prior Art

To intermittently convey sheets through various stations of a platen press with a dwell period at each station, conveying device comprising a pair of endless chains having gripper bars extending therebetween have been utilized. The endless chains are moved by a drive shaft having driving sprockets engaging each of the chains which are supported in their paths by at least one additional driven or idler sprocket. Although the driving sprockets intermittently advance the chains, the inertia forces developed by the movement of the endless chain conveyor have been compensated during a dwell period of the drive shaft by applying a braking action from a pneumatic brake device directly acting on the drive shaft of the drive sprockets. An example of such a device is described in Swiss Patent No. 323,629 dated Aug. 15, 1957. Although a device for conveying sheets between stations with a dwell period provided with a brake as described in this manner is a reliable system, it has certain short comings such as a poor adaptability for high speed operation and it requires continual resetting and adjustments of the braking device for proper inertia compensation.

SUMMARY OF THE INVENTION

The present invention is directed to providing a device for conveying sheets between stations with a dwell period at each station in which device the duration of the application of the braking action as well as the particular instant at which it is applied may be adjusted. The device of the present invention also provides easier access for adjusting the braking system. Another advantage of the present invention is enabling a simplified drive mechanism for an endless chain conveyor which is utilized in the device for conveying and to reduce the dimensions of the components of the drive mechanism of the conveyor.

To accomplish these aims, the present invention is directed to an improvement in a device for conveying a sheet between stations of a platen press with a dwell period at each station. The device has a pair of endless chains arranged within side frames of the press, gripper bars attached by their ends to the spaced pair of endless chains and extending therebetween, a drive shaft extending between the side frames and mounted for rotation, said drive shaft having a drive sprocket for each of said pair of endless chains, at least one driven sprocket for each of said pair of endless chains mounted on the side frames in spaced relation to the drive shaft, means for intermittently rotating said drive shaft including a pinion connected to the drive shaft by a one-way clutch, a sector gear mounted for oscillating movement and engaging the pinion, and a connecting rod for transferring movement of an eccentric to the sector gear with the improvements comprising at least one of the driven sprockets having an axial extension, braking means supported on the side frame adjacent each axial extension for engaging the extension, means including at least one blower for cooling said braking means, and means for actuating said braking means including a control shaft mounted for rotation and making one complete revolution for each cycle of oscillation of the sector gear, said control shaft having means for causing the engagement and disengagement of the braking means during a portion of each revolution thereof.

The extension may either support a disk with the braking means comprising at least one disk brake jaw for engaging the disk, support a brake drum with the braking means being brake shoes that engage the brake drum, or the extension may be a cylindrical surface with the braking means being a band brake having a band engagement the cylindrical surface.

Preferably, the braking means are hydraulically actuated braking means for actuating each of the braking means and includes a valve for selectively applying a hydraulic pressure to each of said brake means and the means for causing the engagement and disengagement actuates the valve to selectively apply the hydraulic pressure to each of the brake means during each revolution of the control shaft. The valve may be actuated by a cam which is mounted on the control shaft or may be a solenoid-type valve which is actuated by a magnetic scanning means which senses the beginning and end of a notch in a disk-shaped programmer that is mounted on the control shaft, and applies a signal to the valve as the notch passes thereby during each revolution of the control shaft.

Preferably, the disk-shaped programmer consists of two flanges which have a notch and are adjustable relative to each other to enable varying the annular length of the notch. The flanges are also adjustably mounted on the control shaft so that the time of actuation of the valve can be regulated with regard to particular point in the cycle of movement of the sector gear.

BRIEF DESCRIPTION OF THE DRAWINGS

FIG. 3 is an end view of a sprocket wheel equipped with a disk brake in accordance with the present invention;

FIG. 4 is a cross-sectional view with portions in elevation taken along lines IV—IV of FIG. 3;

FIG. 5 is an end view of a control programmer for the brake means in accordance with the present invention; and FIG. 6 is a cross-sectional view taken along lines VI—VI of FIG. 5.

DESCRIPTION OF THE PREFERRED EMBODIMENT

Figure 1:
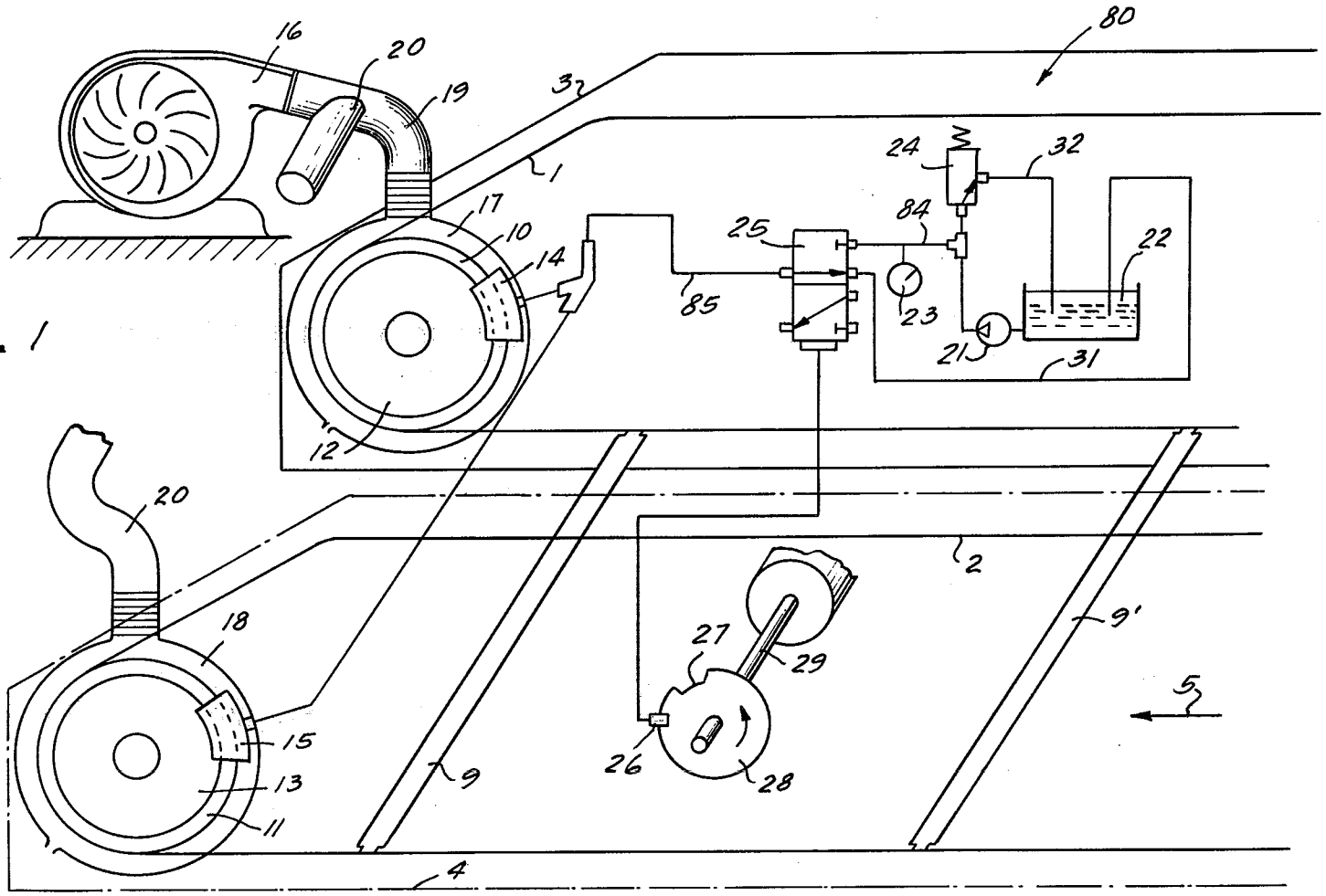
FIG. 1 is a partial perspective view schematically illustrating the conveying device according to the present invention.
Figure 2:
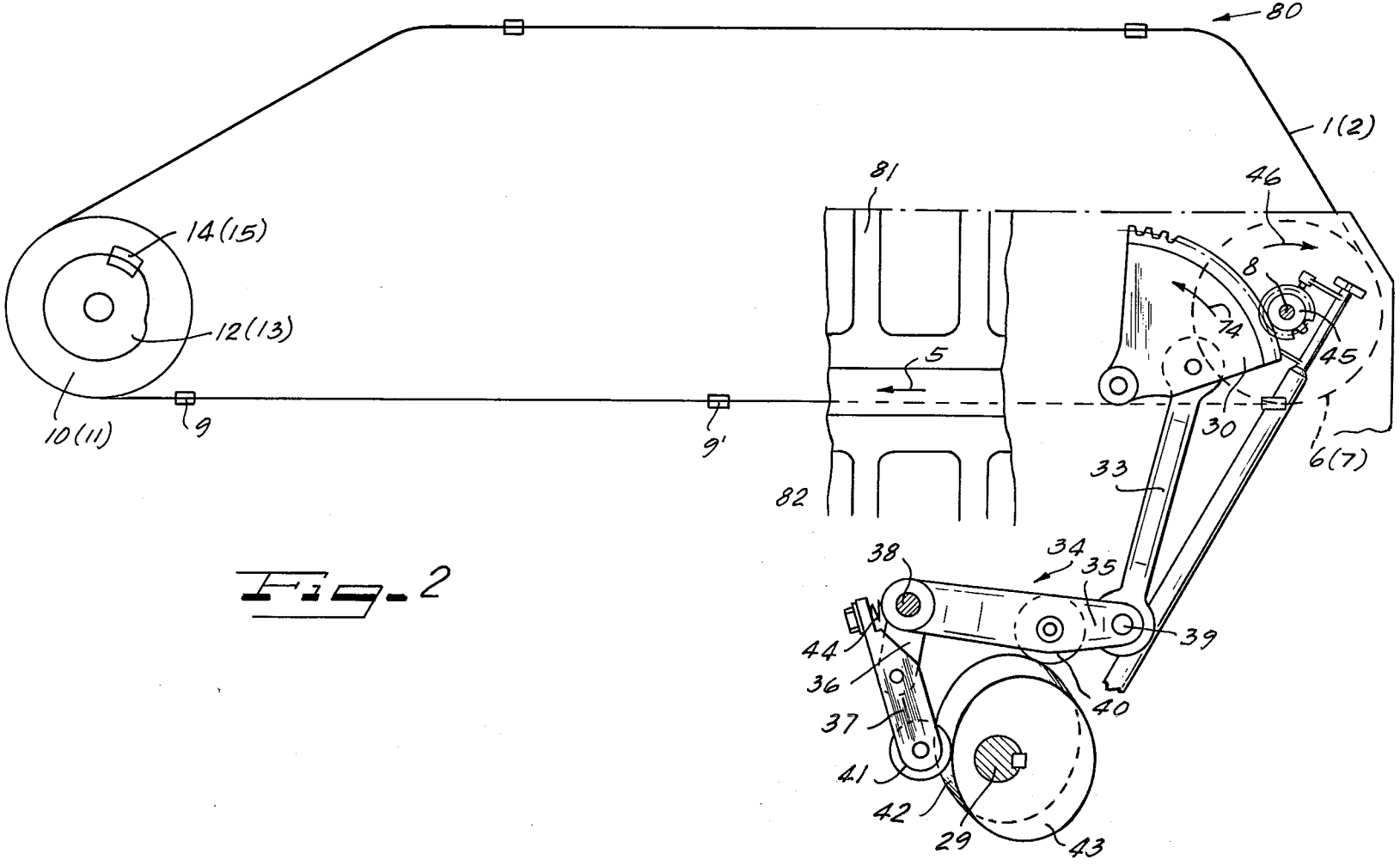
FIG. 2 is a side view with portions broken away for purposes of illustrating the driving arrangement for the conveying device of the present invention.

The principles of the present invention are particularly useful in a conveyor device generally indicated at 80 in FIGS. 1 and 2 for conveying a sheet of material intermittently through a pair of spaced platens 81 and 82 (FIG. 2) and other stations of a platen press. In a platen press, one of the two platens 81 and 82 is reciprocated against the other platen which is fixed in the frame of the press to form a working station.

The conveying device 80 is formed by a pair of spaced endless chains 1 and 2 which are positioned inside a pair of spaced side frames 3 and 4 (FIG. 1) of the platen press. The endless chains 1 and 2 are driven in a direction of arrow 5 by drive sprockets 6 and 7 which are mounted on a drive shaft 8 (FIG. 2) which extends between the side frames and is mounted for rotation. The two spaced endless chains 1 and 2 are linked together by a plurality of gripper bars such as 9 and 9' which have their ends connected to the chains by known connecting devices which enable disconnection of each of the bars from the chains as desired. An example of a known connecting device for the gripper bars is disclosed in Swiss Patent No. 466,690 which issued on Dec. 5, 1968.

Each of the endless chains 1 and 2 travel in a closed path which is partially defined by driven or idler sprocket gears 10 and 11 which are mounted for rotation on their respective side frames 3 and 4 at an end opposite to the drive shaft 8. In addition, other idlers, not illustrated, are utilized for guiding the chains in the desired path.

Each of the sprocket wheels 10 and 11 have axial extension which is engaged by brake means. As illustrated in the Figures, the axial extension support disks 12 and 13 which are engaged by pressure pads contained in disk brake jaws 14 and 15, respectively. To prevent each of the disk brakes from overheating, cooling means are provided. As illustrated, the cooling means comprises at least one blower 16 which is connected by means of conduits or pipes 19 and 20 to respective chambers 17 and 18 which surround their respective disk 12 and 13 as well as the jaws 14 and 15.

As illustrated, each of the disk brakes is a hydraulically actuated brake and the jaws have brake pads or shoes which are urged into engagement with the disk by hydraulic pressure. To apply a hydraulic pressure to the jaws 14 and 15, a pump 21 having an inlet connected to a reservoir 22 provides a discharge pressure into a discharge or pressure line 84 (FIG. 1). The pressure on the line 84 can be read by a gauge such as a manometer 23 and the pressure is adjusted by means of a pressure regulator 24 which discharges excess fluid back to the reservoir 22 through a discharge line 32. Pressure line 84 is connected to a housing of a three-way valve 25 which housing is also connected to the reservoir 22 by a conduit 31 and to each of the brake jaws 14 and 15 by a conduit 85. The valve 25 has two positions with one position connecting conduit 85 to the drain line 31 and the other connecting pressure line 84 to conduit 85.

While movement of the valve 25 between the two positions can be accomplished by a rotating cam arrangement, the control of the valve 25, which is preferably a solenoid valve, is accomplished by a magnetic scanner 26 (FIG. 1) which detects the beginning and end of a notch 27 which is provided in the circumference of a programmer or disk 28 which is mounted on the end of a shaft 29 to rotate therewith. The shaft 29 will make one complete revolution as a sector gear 30 (FIG. 2) oscillates back and forth through one complete cycle. When the notch 27 is detected, the scanner 26 creates a signal which is used to shift the valve from the position connecting the conduit 85 to drain line 31 to the position connecting the pressure line 84 to the conduit 85 to apply the hydraulic actuating fluid to the brake jaws 14 and 15 to apply a braking force on the conveying device 80.

As illustrated in FIG. 2, the sector gear 30 is pivotably mounted for oscillating movement on a portion of the frame of the press and engages a pinion gear 45 which is connected to the drive shaft 8 by a one-directional drive device such as a conventional one-way clutch. To oscillate the sector gear 30, a connecting rod 33 extends from the sector gear to a lever system 34 which consists of three levers or arms 35, 36 and 37. The arms 35 and 36 are permanently mounted or keyed to a rotatable axle 38 for pivotable movement around the axle 38. The end of the arm 35 is connected to the connecting rod 33 by a pivotable joint 39 and the end of the arm 36 acts as a pivot point for the arm 37. The arm 35 has a cam follower such as a roller 40 which is rotatably mounted at a point of a certain distance from the pivotable connection 39. The arm 37 also has a follower such as a roll 41 which is mounted for rotation at the end of the arm 37. The cam followers 40 and 41 follow the profile of two cams 42 and 43 which are keyed on the shaft 29. The end of the arm 37 opposite the end carrying the follower 41 is provided with a multi-layer compression spring 44 to provide permanent pressure on the cam follower 41 to hold it in contact with the cam 43. Thus, the cams 42 and 43 on the rotating shaft 29 with the various followers form an eccentric drive for oscillating the sector gear 30 about its pivotable mounting. Due to the presence of the one-way clutch, the sector gear 30 will only rotate the drive shaft 8 in the direction 46 as it pivots in the direction of arrow 74 during a return stroke of the sector gear 30, no rotational movement is applied to the shaft 8.

As mentioned before, the programmer or disk 28 is mounted on a shaft which makes on complete revolution per cycle of the oscillating sector gear 30. As illustrated, the disk or programmer 28 is mounted on the shaft 29 of the eccentric drive.

The structure of the driven or idler sprockets such as 11 and the braking means such as the disk brake jaws 15 are best illustrated in FIGS. 3 and 4. As illustrated, the idler sprocket 11 is supported on a stub 49 which is secured in the side frame 4 by screws 54. The sprocket 11 has a hub 50 which supports a rim 52 that is secured thereon by fasteners or screws 53. The hub 50 is supported for rotation on the stub 49 by a pair of roller bearings 55, 56 which are held in spaced relationship by a bushing 57. The disk 13 of the disk brake means is secured on the hub 50 by screws or fastening means 51 so that it is concentric therewith. The disk brake jaw 15 is mounted by screws 47 on an extension 48 which extension 48 is secured to a sleeve or bushing 58 that is keyed to the stub shaft 49 by a key 59. To hold the sleeve 58 in the desired axial position on the shaft 49, a retaining plate 60 is secured to the stub 49 by a threaded fastener 61.

As mentioned above, a disk-shaped programmer 28 has a notch 27 whose beginning and end is sensed by a magnetic scanner 26. The preferred construction of the programmer 28 is formed by a pair of flanges or disks 62,63 with the disk 62 having a circumferential cut-out part or notch 64 and the disk 63 having a similar cut-out part or notch 65. The disk 62 is secured on a hub 66 by three screws 67. The disk 63 has three annular spaced slots 68 and is adjustably mounted on the hub 66 by screws or fasteners 69 extending through the slot 68. By relative rotation of the flange or disk 63 to the flange or disk 62, the annular or circumferential length of the notch 27 may be changed to vary the length or duration during which the hydraulic pressure will be applied to the disk brake jaws 14 and 15.

In addition to changing the size of the notch 27, the position of the notch can be annularly shifted on the shaft 29 by rotating the hub 66 thereon. As illustrated, the hub 66 is secured to the end of the shaft 29 by a plurality of dogs 70 which have screws 71.

As illustrated in FIG. 6, the hub is rotatably supported in one of the side frames such as 4 which side frame also supports the magnetic scanning or sensor 26. As illustrated, the sensor 26 is secured by screws 72 to the side frame with the desired position on the scanner 26 along the axis of the shaft 29 being controlled by a shim such as 73.

In operation the conveying device 80 functions as follows. With one complete revolution of the shaft 29, the eccentric drive causes the sector gear 30 to oscillate through one cycle of back and forward movement about its mounting in the frame. When the sector gear moves in the direction 74 it will rotate the drive shaft 8 in the direction of 46 and this will move the conveyors in the direction of arrow 5 (FIG. 2). When the sector gear moves in a direction opposite to the direction 74, the one-way clutch connecting the pinion 45 to the shaft 8 will not transfer this motion to the drive shaft 8. However, inertia of the moving conveyor chains in the direction 5 will cause the chains to continue to move in that direction after the sector gear has ceased to move in direction 74. To compensate for this inertia and to prevent overstraining the drive mechanism, it is desirable to apply a braking force to slow down the chains and to hold them in a fixed relative position during a dwell in the intermittent conveying. The particular time of applying the braking force will depend on various operational requirements. Overover, it is important to easily control both the moment at which the braking force is applied and the duration of the braking force. This is accomplished by rotating the hub 66 with the two disks 62,63 on the shaft 29 so that the beginning of the notch during rotation of the programmer 28 is sensed at the desired time for applying the braking force. The duration of the application of the braking force will be determined by the annular length of the notch 27 which length is adjustable by relative movement of the disk 63 to the disk 62. When the end of the notch is sensed, the braking force will be removed. It should be noted that as illustrated, the braking force is applied for only a portion of the dwell period of the conveying device.

Although various minor modifications might be suggested by those versed in the art, it should be understood that we wish to employ within the scope of the patent granted hereon, all such modifications as reasonably and properly come within the scope of our contribution to the art.

We claim:

1. In a device for conveying a sheet between stations of a platen press with a dwell period at each station, said device comprising a pair of endless chains arranged within side frames of the press, gripper bars attached by their ends to the spaced pair of endless chains and extending therebetween, a drive shaft extending between the side frames and mounted for rotation, said drive shaft having a drive sprocket for each of said pair of endless chains, at least one driven sprocket for each of said pair of endless chains mounted on the side frames in spaced relation to the drive shaft, means for intermittently rotating said drive shaft including a pinion connected to the drive shaft by a one-way clutch, a sector gear mounted for oscillating movement and engaging the pinion and a connecting rod for transferring movement of an eccentric to the sector gear, the improvements comprising at least one of the driven sprockets having an axial extension, braking means supported on the side frame adjacent said one driven sprocket for engaging said extension, means including at least one blower for cooling said braking means, and means for actuating said braking means including a control shaft mounted for rotation and making one complete revolution for each cycle of oscillation of the sector gear, said control shaft having means for causing the engagement and disengagement of the braking means during a portion of each revolution thereof.

2. In a device according to claim 1, wherein each of said extensions supports at least one disk and wherein the braking means comprises at least one disk brake jaw for engaging each disk.

3. In a device according to claim 1, wherein each extension supports a brake drum and wherein the braking means is a drum brake having shoes engaging said brake drum.

4. In a device according to claim 1, wherein the extension has a cylindrical surface and wherein the braking means comprises a band brake having a band engaging said cylindrical surface.

5. In a device according to claim 1, wherein each of said braking means are hydraulic actuated braking means and wherein the means for actuating each of said braking means includes a valve for selectively applying pressure to each of said braking means and wherein said means for causing the engagement and disengagement actuates said valve to selectively apply a hydraulic pressure to each of the braking means during each revolution of the control shaft.

6. In a device according to claim 5, wherein said means for causing the engagement comprises a cam mounted on said control shaft, said cam actuating said valve.

7. In a device according to claim 5, wherein the valve is a solenoid-actuated valve, wherein said means for causing the engagement and disengagement comprises a disk having a notch mounted on the control shaft, and magnetic scanning means positioned adjacent to said disk for sensing said notch and applying a signal to the valve as the notch passes thereby during each revolution of the control shaft.

8. In a device according to claim 7, wherein the notch disk consists of two notch flanges which are adjustable in relation to each other to enable varying the annular length of the notch.

9. In a device according to claim 8, wherein both of said flanges are adjustably mounted on the control shaft so that the actuation of the valve can be regulated with regard to particular point in the cycle of the movement of the sector gear.

10. In a device according to claim 7, wherein each of said extensions supports at least one brake disk and wherein the braking means comprises at least one disk brake jaw for engaging each brake disk.

* * * * *